US009240118B2

(12) United States Patent
Melton

(10) Patent No.: US 9,240,118 B2
(45) Date of Patent: Jan. 19, 2016

(54) SYSTEMS AND METHODS FOR BEACON TETHERING IN A MONITORING SYSTEM

(71) Applicant: BI Incorporated, Boulder, CO (US)

(72) Inventor: Donald A. Melton, Boulder, CO (US)

(73) Assignee: BI Incorporated, Boulder, CO (US)

( * ) Notice: Subject to any disclaimer, the term of this patent is extended or adjusted under 35 U.S.C. 154(b) by 143 days.

(21) Appl. No.: 14/188,210

(22) Filed: Feb. 24, 2014

(65) Prior Publication Data

US 2014/0266707 A1 Sep. 18, 2014

Related U.S. Application Data

(60) Provisional application No. 61/782,974, filed on Mar. 14, 2013.

(51) Int. Cl.
*G08B 23/00* (2006.01)
*G08B 21/22* (2006.01)

(52) U.S. Cl.
CPC ..... *G08B 21/22* (2013.01)

(58) Field of Classification Search
USPC ..... 340/573.1, 539.11, 539.1, 539.13, 340/539.15
See application file for complete search history.

(56) References Cited

U.S. PATENT DOCUMENTS 8,131,465 B2 * 3/2012 Eitan ..... G01S 19/34 340/573.1
8,866,619 B2 * 10/2014 Knibbe ..... H05B 37/0227 340/426.22
2012/0299733 A1 * 11/2012 Knibbe ..... H05B 37/0227 340/573.1

* cited by examiner

*Primary Examiner* — Travis Hunnings
(74) *Attorney, Agent, or Firm* — Hamilton DeSanctics & Cha

(57) ABSTRACT

Various embodiments of the present inventions are related to monitoring physical location of a monitored target, but not limited to, use of beacon location information.

20 Claims, 4 Drawing Sheets

SYSTEMS AND METHODS FOR BEACON TETHERING IN A MONITORING SYSTEM

CROSS REFERENCE TO RELATED APPLICATION

The present application claims priority to (i.e., is a non-provisional of) U.S. Pat. App. No. 61/782,974 entitled "Tethered Beacon", and filed Mar. 14, 2013 by Melton. The entirety of the aforementioned application is incorporated herein by reference for all purposes.

BACKGROUND OF THE INVENTION

The present invention is related to monitoring systems, and in particular to ensuring the integrity of location information relied upon in a monitoring system.

Large numbers of individuals are currently housed in prisons. This represents a significant cost to society both in terms of housing expense and wasted productivity. Remote monitoring the location and movement of individuals provides a cost effective alternative to incarceration. In some cases, the monitoring relies on input from fixed location beacons to indicate a location of the monitored individual. Where the integrity of the location information available form the fixed location beacons is undermined, the location information about a monitored individual is also undermined.

Hence, there exists a need in the art for advanced systems and methods for ensuring the integrity of location information derived from a fixed location beacon.

BRIEF SUMMARY OF THE INVENTION

The present invention is related to monitoring systems, and in particular to ensuring the integrity of location information relied upon in a monitoring system.

Various embodiments of the present invention provide tethered device systems that include: a tether detection circuit, a first motion sensing circuit, a second motion sensing circuit, and a selector circuit. The tether detection circuit is operable to provide a tether output that indicates a connection between a tethered device and an active tether. The first motion sensing circuit is operable to provide a first motion output that indicates motion of the tethered device. The first motion sensing circuit provides a first motion sensitivity. The second motion sensing circuit is operable to provide a second motion output that also indicates motion of the tethered device. The second motion sensing circuit provides a second motion sensitivity. The selector circuit is operable to select one of the first motion output or the second motion output as a motion indication output based at least in part on the tether output.

This summary provides only a general outline of some embodiments of the invention. The phrases "in one embodiment," "according to one embodiment," "in various embodiments", "in one or more embodiments", "in particular embodiments" and the like generally mean the particular feature, structure, or characteristic following the phrase is included in at least one embodiment of the present invention, and may be included in more than one embodiment of the present invention. Importantly, such phases do not necessarily refer to the same embodiment. Many other embodiments of the invention will become more fully apparent from the following detailed description, the appended claims and the accompanying drawings.

BRIEF DESCRIPTION OF THE DRAWINGS

A further understanding of the various embodiments of the present invention may be realized by reference to the figures which are described in remaining portions of the specification. In the figures, similar reference numerals are used throughout several drawings to refer to similar components. In some instances, a sub-label consisting of a lower case letter is associated with a reference numeral to denote one of multiple similar components. When reference is made to a reference numeral without specification to an existing sub-label, it is intended to refer to all such multiple similar components.

DETAILED DESCRIPTION OF THE INVENTION

Figure 1:
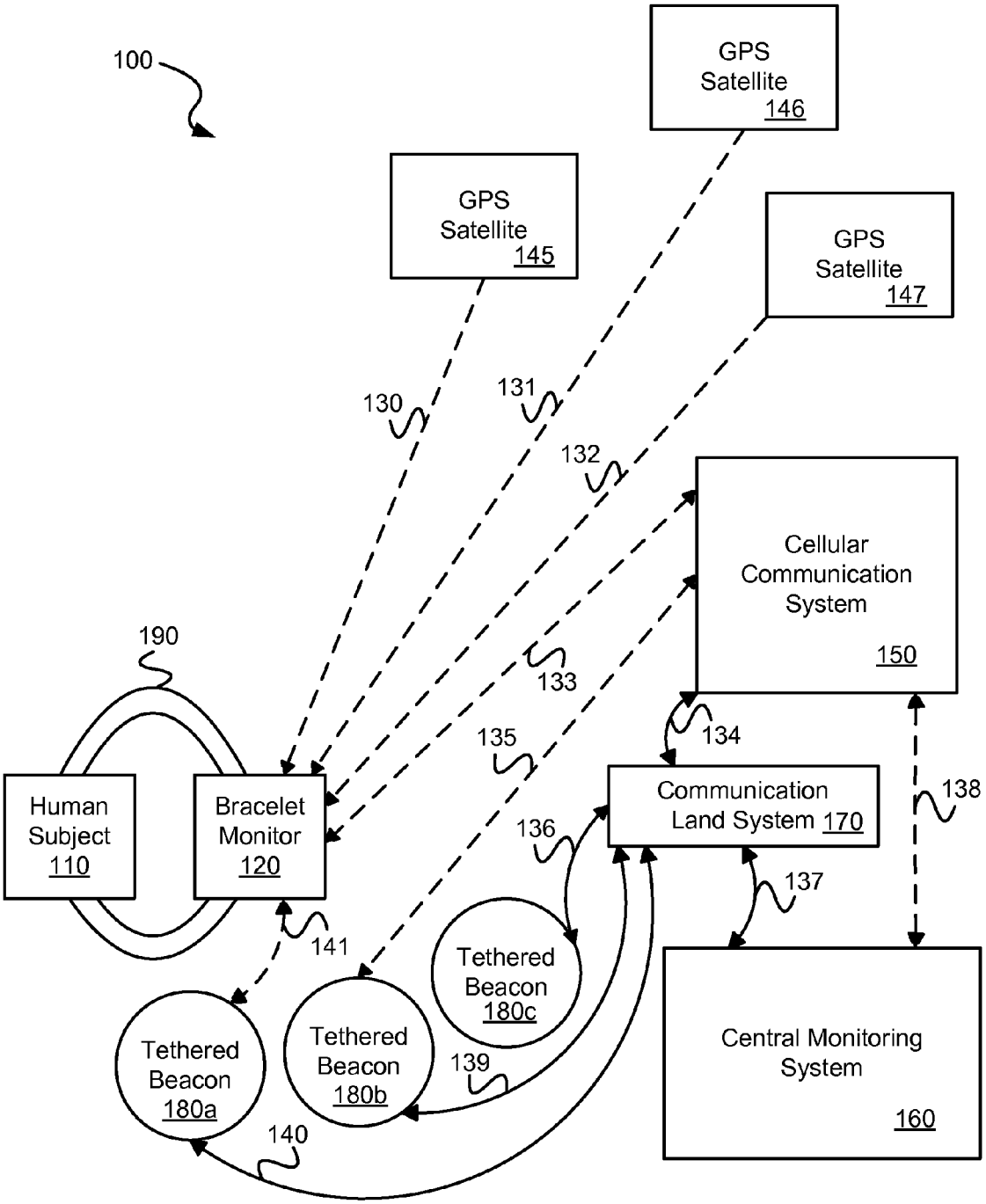
FIG. 1 depicts a tracking and monitoring system including tethered beacons in accordance with various embodiments of the present invention.

The present invention is related to monitoring systems, and in particular to ensuring the integrity of location information relied upon in a monitoring system.

Various embodiments of the present invention provide tethered device systems that include: a tether detection circuit, a first motion sensing circuit, a second motion sensing circuit, and a selector circuit. The tether detection circuit is operable to provide a tether output that indicates a connection between a tethered device and an active tether. The first motion sensing circuit is operable to provide a first motion output that indicates motion of the tethered device. The first motion sensing circuit provides a first motion sensitivity. The second motion sensing circuit is operable to provide a second motion output that also indicates motion of the tethered device. The second motion sensing circuit provides a second motion sensitivity. The selector circuit is operable to select one of the first motion output or the second motion output as a motion indication output based at least in part on the tether output.

In some instances of the aforementioned embodiments, the first motion sensitivity is more sensitive than the second motion sensitivity. In some such instances, the second motion output is selected as the motion indication output when the tether output indicates that the tethered device is connected to the active tether. In some instances, the first motion output is selected as the motion indication output when the tether output indicates that the tethered device is not connected to the active tether.

In various instances of the aforementioned embodiments, the active tether is a fixed location power source. In one particular case, the fixed location power source is an AC wall outlet, and a connection between the tethered device and the AC wall outlet is via a power cord. In one or more instances of the aforementioned embodiments, both the first motion sensing circuit and the second motion sensing circuit are operable to actively detect motion of the tethered device at the same time. In other instances the first motion sensing circuit is enabled when the tether output indicates that the tethered device is not connected to the active tether, and the second motion sensing circuit is enabled when the tether output indicates that the tethered device is connected to the active tether.

In some such instances, the selector circuit is operable to enable one of the first motion sensing circuit or the second motion sensing circuit based at least in part on the tether output to yield the motion indication output.

In some instances of the aforementioned embodiments, the tethered device is a tethered beacon in a monitoring system, and the tethered beacon is operable to transmit a movement message when the motion indication output indicates movement. In some cases, the tethered beacon includes a beacon identification. This beacon identification may be associated with a physical location of the tethered beacon. In other cases, the beacon identification itself includes a physical location representing the location of the tethered beacon, and the tethered beacon is operable to transmit the beacon identification including the physical location.

Other embodiments of the present invention provide methods for providing location information. The methods include: associating a beacon identification with a tethered beacon; determining whether the tethered beacon is tethered to an active tether to yield a tethered output; selecting one of a first motion output from a first motion sensing circuit or a second motion output from a second motion sensing circuit as a motion indication output based at least in part on the tethered output; and transmitting at least one of the motion indication output and the beacon identification. The first motion output is provided by a first motion sensing circuit exhibiting a first motion sensitivity and indicates motion of the tethered beacon. The second motion output is provided by a second motion sensing circuit exhibiting a second motion sensitivity and also indicates motion of the tethered beacon; and wherein the first motion sensitivity is more sensitive to motion than the second motion sensitivity.

In some instances of the aforementioned embodiments, the second motion output is selected as the motion indication output when the tether output indicates that the tethered device is connected to the active tether. In some instances, the first motion output is selected as the motion indication output when the tether output indicates that the tethered device is not connected to the active tether. In various instances of the aforementioned embodiments, the active tether is a fixed location power source.

Yet other embodiments of the present invention provide monitoring systems that include a tethered beacon and a monitoring device. The tethered beacon including a beacon identification includes: a tether detection circuit operable to provide a tether output where the tether output is operable to indicate a connection between a tethered beacon and an active tether; a first motion sensing circuit operable to provide a first motion output that indicates motion of the tethered device; a second motion sensing circuit operable to provide a second motion output that also indicates motion of the tethered device. The first motion sensing circuit provides a first motion sensitivity, and the second motion sensing circuit provides a second motion sensitivity. The tethered beacon further includes: a selector circuit operable to select one of the first motion output or the second motion output as a motion indication output based at least in part on the tether output; and a transmission circuit operable to transmit the beacon identification and the motion indication. The monitoring device is adapted to be attached to a monitor target and includes: a location system operable to identify a location of the monitoring device using one of a non-beacon based system, and a beacon system; and a location transmission system operable to transmit the location of the monitoring device to a central monitoring system. The location system is operable to receive the beacon identification and the motion indication when the monitor device is within range of the tethered beacon.

In some instances of the aforementioned embodiments, the location of the monitoring device is derived from the beacon location when the monitor device is within range of the tethered beacon and the motion indication indicates a lack of motion of the tethered beacon. In other instances of the aforementioned embodiments, the location of the monitoring device is derived from the non-beacon based system when either the monitor device is not within range of the tethered beacon or the motion indication indicates motion of the tethered beacon. In some cases, the non-beacon based system may include one or both of a global positioning system circuit, and a cellular based location circuit. In some cases, the active tether is a fixed location power source.

Turning to FIG. 1, a tracking and monitoring system 100 including tethered beacons 180*a*, 180*b*, 180*c* is depicted in accordance with various embodiments of the present invention. Tracking and monitoring system 100 may be tailored for tracking human subjects as is referred in this detailed description. However, it should be noted that various implementations and deployments of tracking and monitoring system 100 may be tailored for tracking other animals or even inanimate objects such as, for example, automobiles, boats, equipment, shipping containers or the like.

Tracking and monitoring system 100 includes, but is not limited to, a bracelet monitor 120 that is physically coupled to a human subject 110 by a securing device 190. In some cases, securing device 190 is a strap that includes a continuity sensor that when broken indicates an error or tamper condition. Further, in some cases, bracelet monitor 120 includes a proximity sensor that is able to detect when it has been moved away from an individual being monitored. When such movement away from the individual is detected, an error or tamper condition may be indicated. Based on the disclosure provided herein, one of ordinary skill in the art will recognize a variety of tamper sensors that may be incorporated in either bracelet monitor 120 or securing device 190 to allow for detection of removal of bracelet monitor 120 or other improper or unexpected meddling with bracelet monitor 120.

Bracelet monitor 120 is designed to provide the location of human subject 110 under a number of conditions. For example, when bracelet monitor 120 is capable of receiving wireless GPS location information 130, 131, 132 from a sufficient number of GPS satellites 145, 146, 147 respectively, bracelet monitor 120 may use the received wireless GPS location information to calculate or otherwise determine the location of human subject 110. Alternatively or in addition, the location of a tethered beacon 180 that is local to bracelet monitor 120 may be used as the location of bracelet monitor 120. As yet another alternative, an AFLT fix may be established based on cellular communication with bracelet monitor 120. It should be noted that other types of earth based triangulation may be used in accordance with different embodiments of the present invention. For example, other cell phone based triangulation, UHF band triangulation such as Rosum, Wimax frequency based triangulation, S-5 based triangulation based on spread spectrum 900 MHz frequency signals. Based on the disclosure provided herein, one of ordinary skill in the art will recognize other types of earth based triangulation that may be used.

As yet another alternative, an AFLT fix may be established based on cellular communications between bracelet monitor 120 and a cellular communication system 150. Furthermore, when wireless communication link 133 between bracelet monitor 120 and cellular communications system 150 is periodically established, at those times, bracelet monitor 120 may report status and other stored records including location fixes to a central monitoring system 160 via wireless communication link 138.

Tracking and monitoring system 100 includes, but is not limited to, at least one tethered beacon 180. Tethered beacons 180 are instrumental for beacon based tracking and monitoring systems. Within FIG. 1, a telemetric wireless link 141 has been depicted between tethered beacon 180*a* and bracelet monitor 120. Each tethered beacon 180 has an adjustable range to make telemetric wireless contact with bracelet monitor 120. At any point in time, depending on each beacon's 180 relative distance to bracelet monitor 120, none, one, or more than one tracking beacons 180 may be within transmission range of a single bracelet monitor 120. Likewise, it is further conceivable under various circumstances that more than one bracelet monitor 120 at times be within in range of a solitary tethered beacon 180.

Telemetric wireless communications path 141 established at times between tethered beacon 180*a* and bracelet monitor 120 illustrates a common feature of various different embodiments of the current invention. Some embodiments of the current invention vary on how, i.e. protocol, and what information and/or signaling is passed over wireless link 141. For example, in more simplified configurations and embodiments, each tethered beacon 180 is limited to repetitively transmitting its own beacon ID and motion sensor information. In that way, once bracelet monitor 120 is within transmission range of tethered beacon 180*a* and establishes wireless or wired reception 141, then bracelet monitor 120 can record and store received beacon ID. In particular cases where tethered beacon 180 is programmed with its physical location in addition to its beacon ID, the physical location information may also be repetitively transmitted. At a later time, for some embodiments of the present invention, bracelet monitor 120 can then report recorded readings from beacons 180 to the central monitoring system 160 over the cellular communication system 150 using wireless links 133 and 138 as depicted in FIG. 1. Furthermore, many embodiments allow for such transmissions and information passing to occur without being noticed by human subject 110, and unnoticed, automatically, and near effortlessly central monitoring system 160 is able to establish records and track human subject's 110 movements and whereabouts.

Of note, a particular tethered beacon 180 includes a beacon ID which may be, but is not limited to, a beacon identification number. This beacon identification number is transmitted to a bracelet monitor in proximity of the particular tethered beacon. This identification number may be associated with a known location of the tethered beacon. As tracking and monitoring system 100 relies on the location associated with the beacon ID provided from the tethered beacon 180 to establish the location of bracelet monitor 120, moving the particular tethered beacon away from the known location undermines the integrity of information provided from bracelet monitor 120 to central monitoring system 160. To avoid this, each of tethered beacons 180 are tethered to a fixed location power source that controls a level of motion sensing provided by the tethered beacon. Tethering beacons 180 to a power source may be done, for example, by connecting the tethered beacon to an AC wall outlet, connecting the tethered beacon to a telephone jack, connecting the tethered beacon to a cable jack, or the like. Based upon the disclosure provided herein, one of ordinary skill in the art will recognize a variety of non-movable power sources to which tethered beacons 180 may be connected in accordance with different embodiments of the present invention.

Tethered beacons 180 each include a multi-level motion sensing circuit that is operable to determine whether a respective tethered beacon 180 is moving. When a particular tethered beacon 180 is connected to a power source, a low sensitivity motion sensor circuit is employed to determine motion. In contrast, when the particular tethered beacon 180 is not connected to a power source, a high sensitivity motion sensor circuit is employed to determine motion. Thus, when tethered beacon 180 is connected to a power source and is less likely to be the subject of problematic motion (i.e., motion that impacts the integrity of location data transferred from bracelet monitor 120 to central monitoring system 160), the motion sensing employed is less sensitive. As such, the possibility of a false positive (e.g., indicating motion of the tethered beacon caused by loud music playing near the tethered beacon) when the tethered beacon 180 is unlikely to be moving is reduced. In contrast, the possibility of problematic motion is increased when tethered beacon 180 is disconnected from the power source, and in such a scenario the motion detection sensitivity is increased. In some cases, tethered beacons 180 include GPS and/or cellular communication based location circuitry that is turned on when motion is detected to obtain an updated location.

In other embodiments or configurations according to the present invention, each tethered beacon 180 also transmit status information related to its own device health and information related from each beacon's 180 internal tampering, movement, or other sensors via a communication system 170 to central monitoring system 160. This allows for detection of movement of beacons 180, and establishing some level of confidence that the physical location associated with each of beacons 180 is accurate.

Likewise, in some other embodiments, each bracelet monitor 120 contains a host of their own tampering, shielding, movement, and/or other sensors related to its own device health. While still further embodiments also include a host of other measurement transducers within bracelet monitor 120 for extracting information, and for later reporting, related to physical properties of human subject 110. For example, measuring for the presence of alcohol and/or other drugs present in human subject 110 may be included in some embodiments of bracelet monitor 120. As one example, the alcohol sensor discussed in U.S. Pat. No. 7,930,927 entitled "Transdermal Portable Alcohol Monitor and Methods for Using Such" and filed by Cooper et al. on Mar. 4, 2008. The entirety of the aforementioned reference is incorporated herein by reference for all purposes.

Tethered beacons 180 in alternative embodiments of the present invention also communicate with central monitoring system 160 independently of bracelet monitor 120. The tracking and monitoring system 100 illustrated in FIG. 1 shows tethered beacon 180*b* having both a wireless communication link 135 with cellular communication system 150, and also illustrates tethered beacon 180*b* having a hardwired communication link 139 with land communication system 170. Tracking and monitoring system 100 is also shown with tethered beacons 180*a*, 180*b*, and 180*c* each having hardwired land communication links 140, 139, and 136 respectively to land communication system 170. Tracking and monitoring system 100 further illustrates land communication system 170 having a hardwired communication link 134 to cellular communication system 150, and a hardwired communication link 137 to central monitoring system 160.

In some embodiments of the present invention, tethered beacons 180 are located in areas frequented by human subject 110 where bracelet monitor 120 is incapable of accessing information from the GPS system, or simply where power used accessing information from a GPS or cellular location system can be saved. Such beacons eliminate the need to perform an AFLT fix and avoid the costs associated therewith. As an example, human subject 110 may have a tethered beacon 180 placed within his home, and one also placed at his place of employment in close proximity to his work area. In this way, the two placed beacons, each at different prescribed times, can interact with his attached bracelet monitor 120 to periodically make reports to central monitoring system 160 to track movements and the whereabouts of human subject 110. All this can be done without incurring the costs associated with performing an AFLT fix.

Figure 2A:
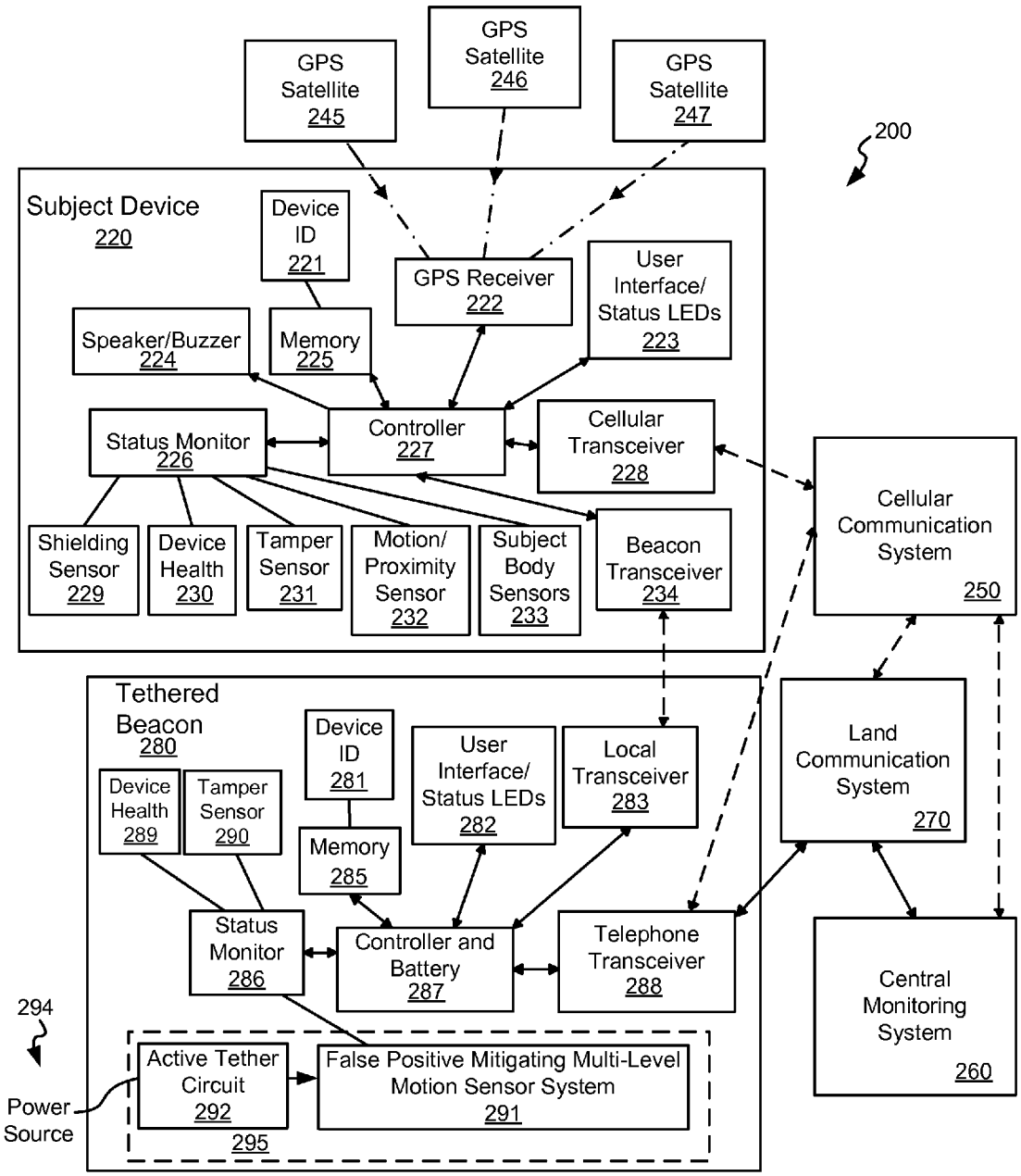
FIG. 2*a* shows a tracking and monitoring system including a single tethered beacon in accordance with some embodiments of the present invention.

Turning to FIG. 2*a*, a tracking and monitoring system 200 including a single tethered beacon 280 in accordance with some embodiments of the present invention. As shown in FIG. 2*a*, tracking and monitoring system 200 includes only a single beacon 280 in communication with a subject device 220 (e.g., a monitoring bracelet). Subject device 220 is similar to or in some instances can be considered identical to a bracelet monitor 120 of FIG. 1. Also, similar to bracelet monitor 120, subject device 220 is capable of receiving GPS information from GPS satellites 245, 246, and 247 respectively. A GPS receiver 222 within subject device 220 at times is useful for determining physical locations, i.e. whenever GPS receiver 222 is powered-on, and also as long as receiving sufficient GPS satellites signal transmissions.

Tracking and monitoring system 200 illustrates subject device's 220 device ID 221 being stored in a memory 225, and is thus accessible by a controller 227. Controller 227 is able to interact with GPS receiver 222 and memory 225 at times for storing and generating records of successively determined GPS locations. Controller 227 may be, but is not limited to, a microprocessor, microcontroller or other device known in the art that is capable of executing software or firmware instructions.

Controller 227 of subject device 220 at times functions in conjunction with a cellular transceiver 228 to send and receive data and signals through cellular communication system 250. This link at times is useful for passing information and/or control signals between central monitoring system 260 and subject device 220. Cellular communication system 250 and cellular transceiver 228 can also at times often be useful for determining a physical location for subject devices 220 through AFLT when requested.

Tracking and monitoring system 200 depicts controller 227 interacting with a beacon transceiver 234. A status monitor 226, a user interface 223, and a speaker/buzzer 224 are all interconnected and interact through controller 227. In alternative embodiments of the present invention, status monitor 226 includes one or more of the following subcomponents: a set of shielding sensors 229 that are capable of determining whether subject device is being shielded from receiving GPS signals and/or if GPS jamming is ongoing, a set of device health indicators 230, a tamper sensor 231 capable of determining whether unauthorized access to subject device 220 has occurred or whether subject device 220 has been removed from an associated human subject, a motion/proximity sensor 232 capable of determining whether subject device 220 is moving and/or whether it is within proximity of human subject 210, and/or other body sensors 233 for making physical measurements of human subject 210. Based on the disclosure provided herein, one of ordinary skill in the art will recognize a variety of shielding sensors, a variety of device health transducers and indicators, a variety of tamper sensors, various different types of motion sensors, different proximity to human sensors, and various human body physical measurement sensors or transducers that may be incorporated into subject device 220 according to various different instances and/or embodiments of the present invention.

Tethered beacon 280 includes a local transceiver 283 capable of providing information to subject device 220, and in some cases receiving information from subject device 220. Communication between beacon transceiver 234 and local transceiver 283 can be either wireless or wired. For example, the communication may be made via Universal Serial Bus protocol over a wired interface. Based on the disclosure provided herein, one of ordinary skill in the art will recognize a variety of wireless and wired interfaces and interface protocols that may be used in relation to different embodiments of the present invention. Tethered beacon 280 further includes a device ID 281 maintained in a memory 285. Device ID 281 uniquely identifies tethered beacon 280, and may in some cases be used to designate an operational difference between beacons (e.g., a beacon used to provide location information to a subject device or a beacon used to find a misplaced or discarded subject device). Tethered beacon 280 may further include a user interface 282 that provides some indication of the operational status of the beacon.

In some instances, tethered beacon 280 includes a telephone transceiver 288 that is capable of communication via one or both of a land communication system 270 or cellular communication system 250. Tethered beacon 280 may also include a status monitor 286 that is capable of accessing information from device health sensors 289, tamper sensors 290 and/or a tether based motion sensing system 295. As shown, tether based motion sensing system 295 includes: an active tether circuit 292 that is operable to determine whether tethered beacon 280 is connected to a power source 294; and a false positive mitigating multi-level motion sensor system 291. Based on the disclosure provided herein, one of ordinary skill in the art will recognize a variety of status information that may be monitored to determine whether tethered beacon 280 is properly operational and whether the location information provided from beacon 280 to subject device 220 is reliable. The various functional elements of tethered beacon 280 are controlled and powered by a controller and battery 287 that may be, but is not limited to, a combination of a battery and a microprocessor, a microcontroller or other device known in the art that is capable of executing software or firmware instructions.

Of note, a location where tethered beacon 280 is deployed is associated with a beacon ID that is programmed into memory 285. This beacon ID is transmitted to subject device 220. As tracking and monitoring system 200 relies on the location associated with the beacon ID provided from tethered beacon 280 to establish its location that is programmed to central monitoring system 260, moving the particular tethered beacon away from the known location undermines the integrity of information provided from bracelet monitor 220 to central monitoring system 260. To avoid this, tethered beacon 280 is tethered to power source 294. Active tether circuit 292 determines whether tethered beacon 280 is attached to power source 294, or is disconnected from power source 294. Any circuit known in the art for determining whether there is a connection to a power source may be used to implement active tether circuit 292. Active tether circuit 292 provides an output indicating whether tethered beacon 280 is connected to power source 294.

False positive mitigating multi-level motion sensor system 291 is operable to detect motion of tethered beacon 280, and provides an indication of any sensed motion to status monitor 286. The level of sensitivity of the motion sensing performed by false positive mitigating multi-level motion sensor system 291 is dynamically selected base upon the output from active tether circuit 292 indicating whether tethered beacon 280 is connected to power source 294. When tethered beacon 280 is connected to power source 294, a low sensitivity motion sensor circuit is employed to determine motion. In contrast, when tethered beacon 280 is not connected to power source 294, a high sensitivity motion sensor circuit is employed to determine motion. Thus, when tethered beacon 280 is connected to a power source and is less likely to be the subject of problematic motion (i.e., motion that impacts the integrity of location data transferred from subject device 220 to central monitoring system 260), the motion sensing employed is less sensitive. As such, the possibility of a false positive (e.g., indicating motion of the tethered beacon caused by loud music playing near the tethered beacon) when the tethered beacon 280 is unlikely to be moving is reduced. In contrast, the possibility of problematic motion is increased when tethered beacon 280 is disconnected from the power source, and in such a scenario the motion detection sensitivity is increased. In some cases, tethered beacon 280 includes GPS and/or cellular communication based location circuitry that is turned on when motion is detected to obtain an updated location.

Figure 2B:
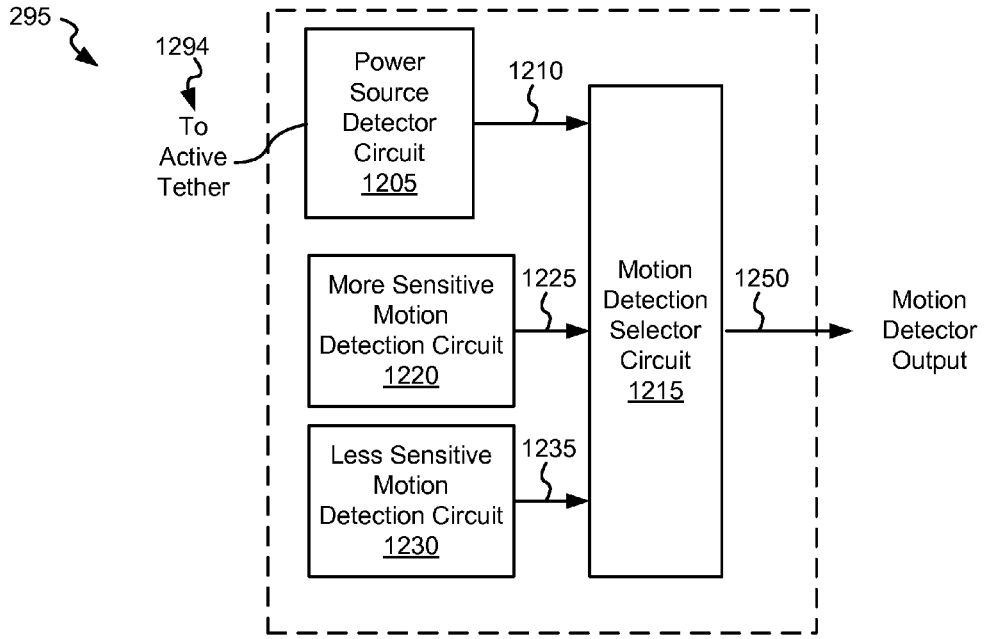
FIG. 2*b* shows one implementation of a tether based motion sensing system in accordance with some embodiments of the present invention.

Turning to FIG. 2*b*, one implementation of tether based motion sensing system 295 is shown in accordance with some embodiments of the present invention. As shown, tether based motion sensing system 295 includes a power source detector circuit 1205 that may be tethered to an active tether 1294. It should be noted that active tether 1294 may be any detectable source including, but not limited to, an AC power outlet, a cable outlet, a telephone outlet, a ground, or other active tether. Power source detector circuit 1205 may be any circuit known in the art for detecting whether tether based motion sensing system 295 is connected to an active tether. Tether based motion sensing system 295 provides a tether detection output 1210 that indicates whether tether based motion sensing system 295 is connected to active tether 1294 or not.

In addition, tether based motion sensing system 295 includes two different motion sensors: a more sensitive motion detection circuit 1220, and a less sensitive motion detection circuit 1230. Less sensitive motion detection circuit 1230 may be, for example, a SignalQuest™ SQ-SEN-815B motion sensor. More sensitive motion detection circuit 1220 may be, for example, a SignalQuest™ SQ-SEN-200 motion sensor. Based upon the disclosure provided herein, one of ordinary skill will recognize other motion sensors that may be used in relation to different embodiments of the present invention.

A motion output 1225 is provided from more sensitive motion detection circuit 1220 that indicates whether motion is detected by more sensitive motion detection circuit 1220; and a motion output 1235 is provided from less sensitive motion detection circuit 1230 that indicates whether motion is detected by less sensitive motion detection circuit 1230. All of tether detection output 1210, motion output 1225, and motion output 1235 are provided to motion detection selector circuit 1215. Motion detection selector circuit 1215 selects one of motion output 1225 or motion output 1235 as a motion detector output 1250 based upon tether detection output 1210. In particular, when tether detection output 1210 indicates tether based motion sensing system 295 is connected to active tether 1294, motion output 1235 is provided as motion detector output 1250. In contrast, when tether detection output 1210 indicates tether based motion sensing system 295 is not connected to active tether 1294, motion output 1225 is provided as motion detector output 1250.

It should be noted that motion detection selector circuit 1215 may be replaced by an enable circuit where operation of less sensitive motion detection circuit 1230 is enabled when tether detection output 1210 indicates tether based motion sensing system 295 is connected to active tether1 294, and disabled when tether detection output 1210 indicates tether based motion sensing system 295 is not connected to active tether 1294. The reverse is also true that operation of more sensitive motion detection circuit 1230 is enabled when tether detection output 1210 indicates tether based motion sensing system 295 is not connected to active tether 1294, and disabled when tether detection output 1210 indicates tether based motion sensing system 295 is connected to active tether 1294.

Figure 3:
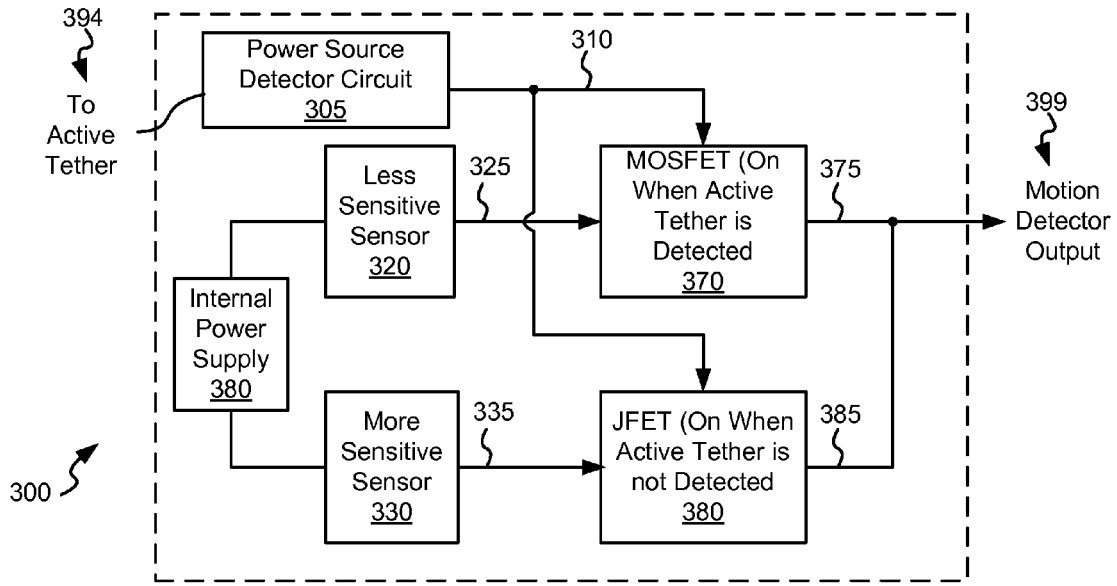
FIG. 3 shows one particular implementation of a tether based motion sensing system in accordance with some embodiments of the present invention.

Turning to FIG. 3, another particular implementation of a tether based motion sensing system 300 is shown in accordance with some embodiments of the present invention. Tether based motion sensing system 300 may be used in place of tether based motion sensing system 295 of FIG. 2*a*. As shown, tether based motion sensing system 300 includes a power source detector circuit 305 that may be tethered to an active tether 394.

It should be noted that active tether 394 may be any detectable source including, but not limited to, an AC power outlet, a cable outlet, a telephone outlet, a ground, or other active tether. Power source detector circuit 305 may be any circuit known in the art for detecting whether tether based motion sensing system 300 is connected to an active tether. Tether based motion sensing system 300 provides a tether detection output 310 that indicates whether tether based motion sensing system 300 is connected to active tether 394 or not.

In addition, tether based motion sensing system 300 includes two different motion sensors: a more sensitive motion detection circuit 330, and a less sensitive motion detection circuit 320. Less sensitive motion detection circuit 320 may be, for example, a SignalQuest™ SQ-SEN-815B motion sensor. More sensitive motion detection circuit 330 may be, for example, a SignalQuest™ SQ-SEN-200 motion sensor. Based upon the disclosure provided herein, one of ordinary skill will recognize other motion sensors that may be used in relation to different embodiments of the present invention. As an example, an accelerometer may be used.

A motion output 335 is provided from more sensitive motion detection circuit 330 that indicates whether motion is detected by more sensitive motion detection circuit 330; and a motion output 325 is provided from less sensitive motion detection circuit 320 that indicates whether motion is detected by less sensitive motion detection circuit 320. Motion output 335 is provided to a JFET device 380 that has its gate connected to tether detection output 310. In operation, when tether detection output 310 is asserted such that connection to active tether 394 is not detected, JFET device 380 passes motion output 335 as a signal output 385. Otherwise, when tether detection output 310 is asserted such that connection to active tether 394 is detected, JFET device 380 presents a high impedance to signal output 385. Motion output 325 is provided to a MOSFET device 370 that has its gate connected to tether detection output 310. In operation, when tether detection output 310 is asserted such that connection to active tether 394 is detected, MOSFET device 370 passes motion output 325 as a signal output 375. Otherwise, when tether detection output 310 is asserted such that connection to active tether 394 is not detected, MOSFET device 370 presents a high impedance to signal output 375. Signal output 375 and signal output 385 are electrically connected to yield a motion detector output 399. In operation, motion detector output 399 corresponds to motion output 325 when tether detection output 310 is asserted such that connection to active tether 394 is detected, and to motion output 335 when tether detection output 310 is asserted such that connection to active tether 394 is not detected.

Figure 4:
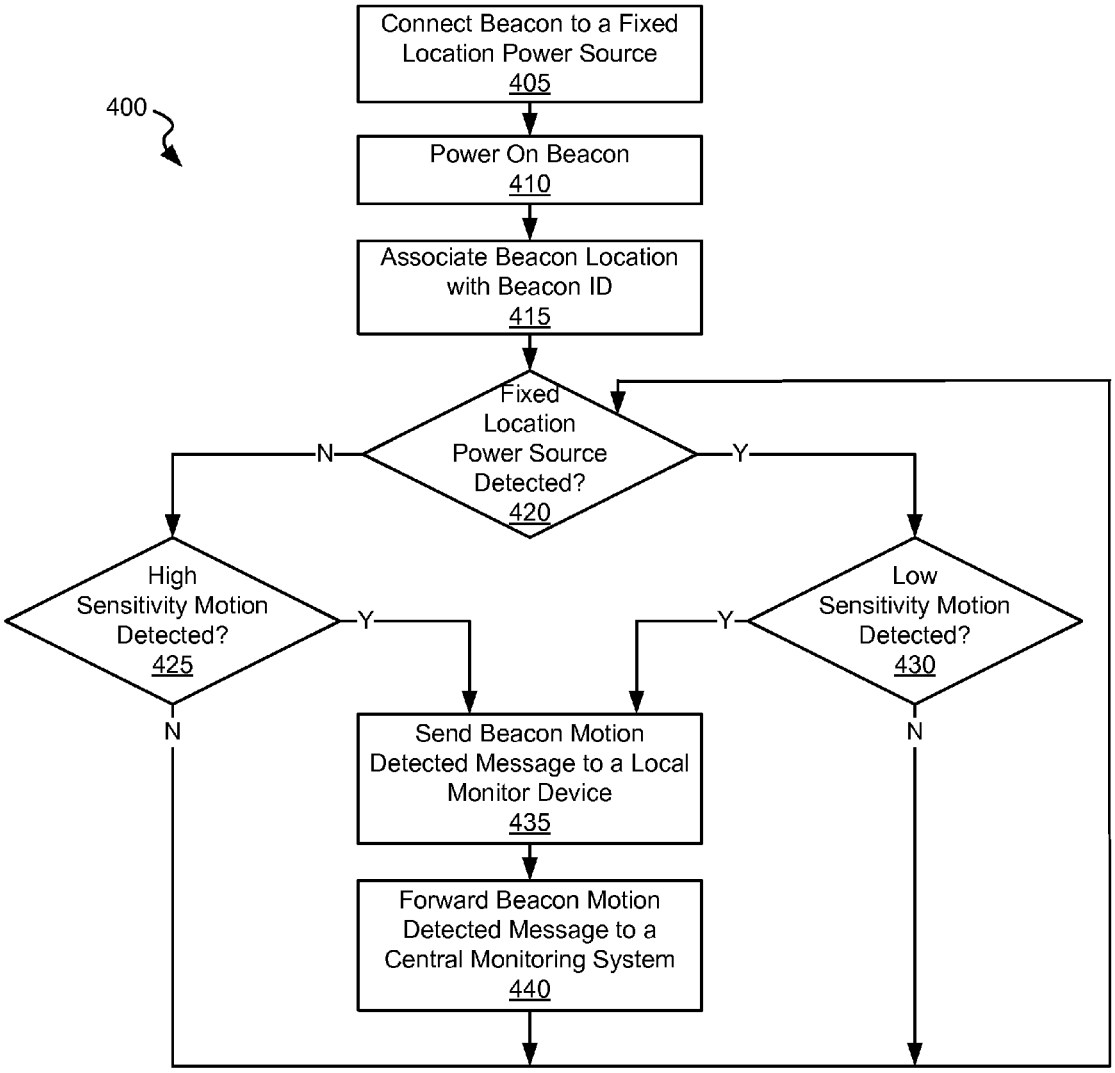
FIG. 4 is a flow diagram showing a method for tether based motion detection in accordance with some embodiments of the present invention.

Turning to FIG. 4, a flow diagram 400 shows a method for tether based motion detection in accordance with some embodiments of the present invention. Following flow diagram 400, a beacon is connected to a fixed location power source (block 405). This may include, for example, connecting the beacon to an AC wall outlet via a power cord. Based upon the disclosure provided herein, one of ordinary skill in the art will recognize other approaches that may be used to connect the beacon to a power source in accordance with different embodiments of the present invention. The beacon is then powered on (block 410). The beacon may be operated by power derived from an internal battery such that when it is disconnected from a power source it remains operational. In some cases, the battery is recharged when connected to a power source. A location for the beacon is associated with a beacon ID that uniquely identifies the tethered beacon (block 415). This may include, for example, associating the coordinates of the physical location of the tethered beacon at a central monitoring location. These coordinates indicate the physical location of a beacon having the corresponding beacon ID in its internal memory.

It is then determined whether the beacon is connected to the fixed location power source (block 420). Connection to the fixed location power source increases a confidence that the location information programmed into the beacon is reliable. Where the fixed location power source is detected (block 420), motion of the beacon is monitored with a low sensitivity motion detection system (block 430). Where the low sensitivity motion detection system does not indicate any motion (block 430), no motion errors are generated. Alternatively, where the low sensitivity motion detection system does indicate motion (block 430), a beacon motion detected message is sent to a local monitor device (e.g., a bracelet monitor within proximity of the tethered beacon) (block 435). This beacon motion message is forwarded by the local monitor device to a central monitoring system (block 440). In some cases, based upon this beacon motion message, local monitor devices previously relying on location information from the tethered beacon, may be directed to turn on their local GPS or cellular location circuitry to provide a more reliable location update.

Alternatively, where the fixed location power source is not detected (block 420), motion of the beacon is monitored with a high sensitivity motion detection system (block 425). Where the high sensitivity motion detection system does not indicate any motion (block 425), no motion errors are generated. Alternatively, where the high sensitivity motion detection system does indicate motion (block 425), a beacon motion detected message is sent to a local monitor device (e.g., a bracelet monitor within proximity of the tethered beacon) (block 435). This beacon motion message is forwarded by the local monitor device to a central monitoring system (block 440). Again, in some cases, based upon this beacon motion message, local monitor devices previously relying on location information from the tethered beacon, may be directed to turn on their local GPS or cellular location circuitry to provide a more reliable location update.

In conclusion, the present invention provides for novel systems, devices, and methods for monitoring human subjects using location information provided from tethered beacons. While detailed descriptions of one or more embodiments of the invention have been given above, various alternatives, modifications, and equivalents will be apparent to those skilled in the art without varying from the spirit of the invention. Therefore, the above description should not be taken as limiting the scope of the invention, which is defined by the appended claims.

What is claimed is:

1. A tethered device system, the system comprising:

a tether detection circuit operable to provide a tether output, wherein the tether output is operable to indicate a connection between a tethered device and an active tether;

a first motion sensing circuit operable to provide a first motion output, wherein the first motion output is operable to indicate motion of the tethered device, and wherein the first motion sensing circuit provides a first motion sensitivity;

a second motion sensing circuit operable to provide a second motion output, wherein the second motion output is operable to indicate motion of the tethered device, and wherein the second motion sensing circuit provides a second motion sensitivity; and a selector circuit operable to select one of the first motion output or the second motion output as a motion indication output based at least in part on the tether output.

2. The system of claim 1, wherein the first motion sensitivity is more sensitive than the second motion sensitivity.

3. The system of claim 2, wherein the second motion output is selected as the motion indication output when the tether output indicates that the tethered device is connected to the active tether.

4. The system of claim 2, wherein the first motion output is selected as the motion indication output when the tether output indicates that the tethered device is not connected to the active tether.

5. The system of claim 1, wherein the active tether is a fixed location power source.

6. The system of claim 5, wherein the fixed location power source is an AC wall outlet, and wherein a connection between the tethered device and the AC wall outlet is via a power cord.

7. The system of claim 1, wherein both the first motion sensing circuit and the second motion sensing circuit are operable to actively detect motion of the tethered device at the same time.

8. The system of claim 1, wherein the first motion sensing circuit is enabled when the tether output indicates that the tethered device is not connected to the active tether, and wherein the second motion sensing circuit is enabled when the tether output indicates that the tethered device is connected to the active tether.

9. The system of claim 8, wherein the selector circuit operable to enable one of the first motion sensing circuit or the second motion sensing circuit based at least in part on the tether output to yield the motion indication output.

10. The system of claim 1, wherein the tethered device is a tethered beacon in a monitoring system, and wherein the tethered beacon is operable to transmit a movement message when the motion indication output indicates movement.

11. The system of claim 10, wherein the tethered beacon includes an identification number that is associated with a physical location of the tethered beacon, and wherein the tethered beacon is operable to transmit the identification number.

12. A method for providing location information, the method comprising:

associating a beacon identification with a tethered beacon;

determining whether the tethered beacon is tethered to an active tether to yield a tethered output;

selecting one of a first motion output from a first motion sensing circuit or a second motion output from a second motion sensing circuit as a motion indication output based at least in part on the tethered output; wherein the first motion output is provided by a first motion sensing circuit exhibiting a first motion sensitivity and indicates motion of the tethered beacon; wherein the second motion output is provided by a second motion sensing circuit exhibiting a second motion sensitivity and also indicates motion of the tethered beacon; and wherein the first motion sensitivity is more sensitive to motion than the second motion sensitivity;

transmitting at least one of the motion indication output and the beacon identification.

13. The method of claim 12, wherein the second motion output is selected as the motion indication output when the tether output indicates that the tethered beacon is connected to the active tether.

14. The method of claim 12, wherein the first motion output is selected as the motion indication output when the tether output indicates that the tethered beacon is not connected to the active tether.

15. The method of claim 12, wherein the active tether is a fixed location power source.

16. A monitoring system, the monitoring system comprising:

a tethered beacon including a beacon identification, wherein the tethered beacon includes:

a tether detection circuit operable to provide a tether output, wherein the tether output is operable to indicate a connection between a tethered beacon and an active tether;

a first motion sensing circuit operable to provide a first motion output, wherein the first motion output is operable to indicate motion of the tethered beacon, and wherein the first motion sensing circuit provides a first motion sensitivity;

a second motion sensing circuit operable to provide a second motion output, wherein the second motion output is operable to indicate motion of the tethered beacon, and wherein the second motion sensing circuit provides a second motion sensitivity;

a selector circuit operable to select one of the first motion output or the second motion output as a motion indication output based at least in part on the tether output;

a transmission circuit operable to transmit the beacon identification and the motion indication; and a monitoring device adapted to be attached to a monitor target, wherein the monitoring device includes:

a location system operable to identify a location of the monitoring device using one of a non-beacon based system, and a beacon system, wherein the location system is operable to receive the beacon identification and the motion indication when the monitor device is within range of the tethered beacon; and a location transmission system operable to transmit the location of the monitoring device to a central monitoring system.

17. The monitoring system of claim 16, wherein the location of the monitoring device is derived from the beacon identification when the monitor device is within range of the tethered beacon and the motion indication indicates a lack of motion of the tethered beacon.

18. The monitoring system of claim 16, wherein the location of the monitoring device is derived from the non-beacon based system when either the monitor device is not within range of the tethered beacon or the motion indication indicates motion of the tethered beacon.

19. The monitoring system of claim 18, wherein the non-beacon based system is selected from a group consisting of: a global positioning system circuit, and a cellular based location circuit.

20. The monitoring system of claim 16, wherein the active tether is a fixed location power source.

* * * * *